US007517043B2

(12) United States Patent
Fitch et al.

(10) Patent No.: US 7,517,043 B2
(45) Date of Patent: Apr. 14, 2009

(54) FLUIDIC STRUCTURES

(75) Inventors: John S. Fitch, Los Altos, CA (US); Scott Elrod, La Honda, CA (US); Jurgen Daniel, Mountain View, CA (US); James W. Stasiak, Lebanon, OR (US); Steven A. Buhler, Sunnyvale, CA (US); Babur B. Hadimioglu, Stockholm (SE); Joy Roy, San Jose, CA (US); Michael C. Weisberg, Woodside, CA (US); James C. Zesch, Santa Cruz, CA (US)

(73) Assignee: Xerox Corporation, Norwalk, CT (US)

( * ) Notice: Subject to any disclaimer, the term of this patent is extended or adjusted under 35 U.S.C. 154(b) by 474 days.

(21) Appl. No.: 11/014,356

(22) Filed: Dec. 16, 2004

(65) Prior Publication Data

US 2006/0132531 A1 Jun. 22, 2006

(51) Int. Cl.
*B41J 2/015* (2006.01)

(52) U.S. Cl. ..... 347/20

(58) Field of Classification Search ..... 347/20, 347/68, 70, 71

See application file for complete search history.

(56) References Cited

U.S. PATENT DOCUMENTS 4,675,083 A 6/1987 Bearss et al.
5,087,930 A 2/1992 Roy et al.
5,124,716 A 6/1992 Roy et al.
5,155,498 A 10/1992 Roy et al.
5,170,177 A 12/1992 Stanley et al.
5,406,318 A 4/1995 Moore et al.
5,489,930 A * 2/1996 Anderson ..... 347/71
5,565,113 A 10/1996 Hadimioglu et al.
5,734,399 A * 3/1998 Weber et al. ..... 347/65
6,134,291 A 10/2000 Roy et al.
6,193,359 B1 2/2001 Patil et al.

(Continued)

OTHER PUBLICATIONS

Hsieh, H. B., Fitch, J., White D., Torres, F., Roy, J., Matusiak, R., Krivacic, B., Kowalski, B., Bruce, R., and Elrod, S., "Ultra-High-Throughput Microarray Generation and Liquid Dispensing Using Multiple Disposable Piezoelectric Ejectors," Journal of Biomolecular Screening, vol. 9, No. 2, 2004, pp. 85-94.

(Continued)

*Primary Examiner*—An H Do
(74) *Attorney, Agent, or Firm*—Leading-Edge Law Group, PLC; James T. Beran

(57) ABSTRACT

Various fluidic techniques can employ ducting structures, such as microstructures, that extend between other components, such as plate-like structures. A ducting structure can, for example, include an inlet opening toward or near one plate-like structure, an outlet opening toward or near another plate-like structure, and a duct in which fluid flows after being received through the inlet opening and before being provided through the outlet opening. In some implementations, a ducting structure is photo-defined, such as by exposing a photo-imageable structure and then removing either exposed or unexposed regions. In some implementations, a ducting structure is a freestanding polymer microstructure. In some implementations, ducting structures are microstructures that extend approximately the same length between first and second plate-like structures, and have a ratio of length to maximum cavity diameter of approximately two or more. A printhead implementation includes an array of such microstructures supported between drive side and drop side assemblies.

29 Claims, 11 Drawing Sheets

U.S. PATENT DOCUMENTS

| | | | | |
|---|---|---|---|---|
| 6,199,970 | B1 | 3/2001 | Roy et al. | |
| 6,334,856 | B1 | 1/2002 | Allen et al. | |
| 6,464,337 | B2 | 10/2002 | Roy et al. | |
| 6,644,774 | B1 | 11/2003 | Burger et al. | |
| 6,669,336 | B1 | 12/2003 | Kneezel et al. | |
| 6,685,299 | B2 * | 2/2004 | Hirota | 347/20 |
| 6,739,704 | B2 | 5/2004 | Takahashi | |
| 6,762,012 | B2 | 7/2004 | Kim et al. | |
| 6,800,849 | B2 | 10/2004 | Staats | |
| 6,803,703 | B2 | 10/2004 | Junhua | |
| 6,805,420 | B2 | 10/2004 | Sumi | |
| 7,288,327 | B2 | 10/2007 | Daniel et al. | |
| 2004/0008242 | A1 | 1/2004 | Andrews | |
| 2005/0133154 | A1 | 6/2005 | Daniel et al. | |
| 2005/0136359 | A1 | 6/2005 | Weisberg | |
| 2006/0103695 | A1 | 5/2006 | Young et al. | |
| 2006/0134448 | A1 | 6/2006 | Daniel et al. | |

OTHER PUBLICATIONS

Office communication mailed Apr. 3, 2007, in U.S. Appl. No. 11/014,357, 12 pages, published in public PAIR.

Amendment with Information Disclosure dated Jun. 29, 2007, in U.S. Appl. No. 11/014,357, 16 pages, published in public PAIR.

Notice of Allowance and Fee(s) Due mailed Sep. 11, 2007, in U.S. Appl. No. 11/014,357, 10 pages, published in public PAIR.

* cited by examiner

FIG. 3
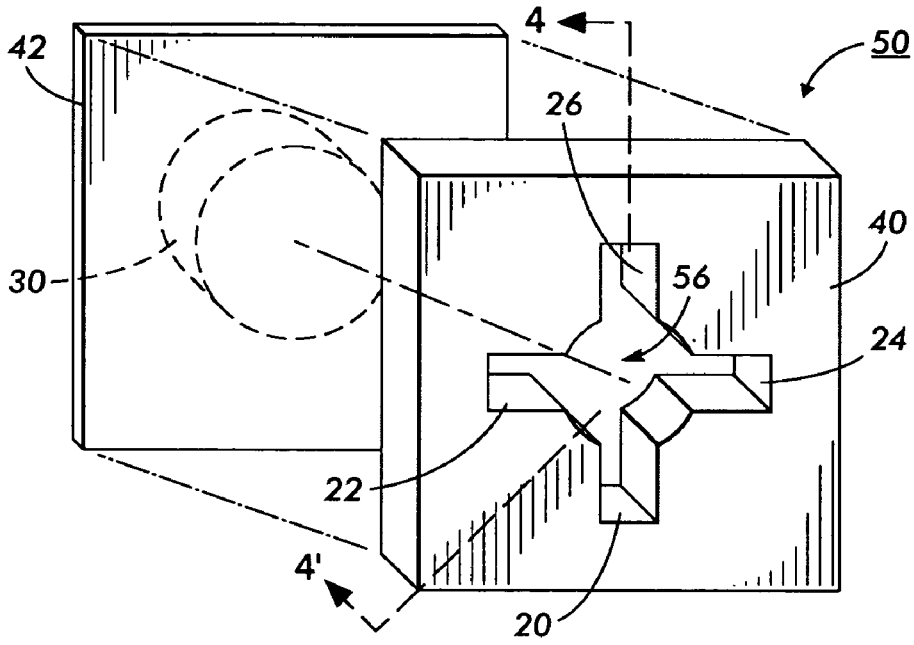
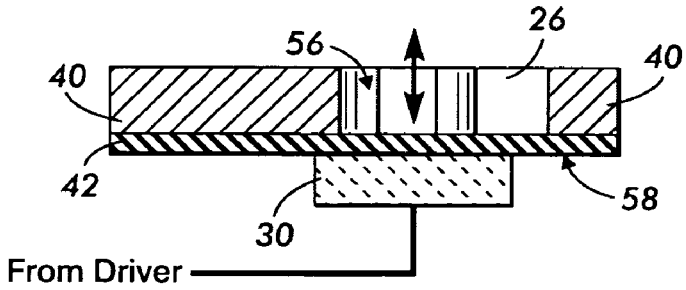
FIG. 4

FIG. 7
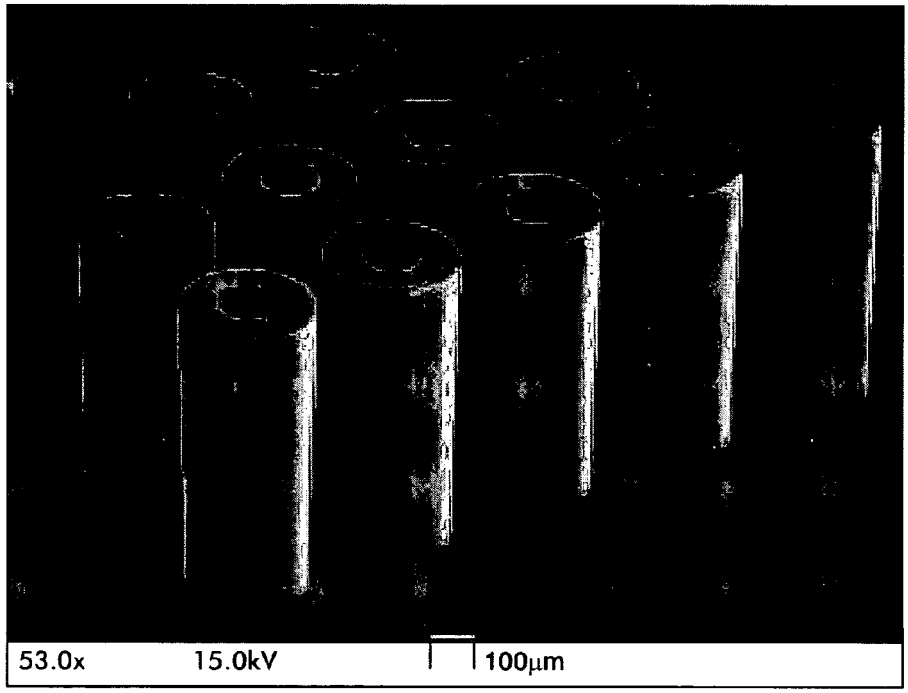
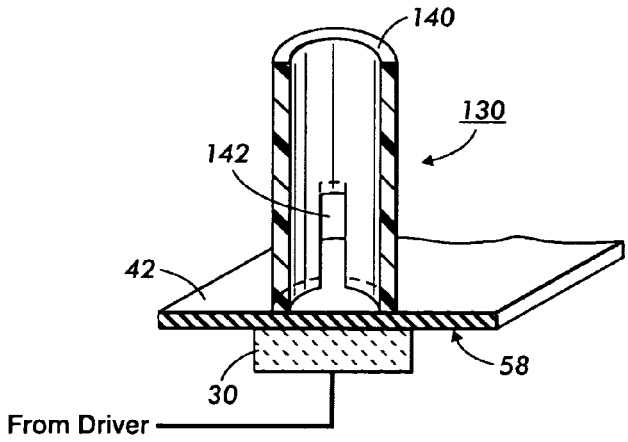
FIG. 8

FLUIDIC STRUCTURES

BACKGROUND OF THE INVENTION

The present invention relates generally to fluidic techniques, i.e. techniques in which devices depend for operation on pressures and flows of fluids in channels. For example, fluidic techniques may be implemented using ducting structures within which fluid can flow.

Many fluidic structures have been proposed, including various structures for printheads and other applications. For example, U.S. Pat. No. 5,087,930, incorporated herein by reference, describes a compact ink jet printhead assembled from metal plates. In all but a nozzle defining plate, features are formed by photo-patterning and etching processes without requiring machining or other metalworking. Different inlet channels are made in different configurations but provide the same fluid impedance.

It would be advantageous to have additional fluidic techniques. In particular, it would be advantageous to have additional fluidic structures for printheads and other applications.

SUMMARY OF THE INVENTION

The invention provides various exemplary embodiments of structures, methods, apparatus, and printheads. In general, each embodiment involves at least one ducting structure, such as a microstructure. A ducting structure can, for example, have an inlet opening, an outlet opening, and a duct in which fluid flows after being received through the inlet opening and before being provided through the outlet opening.

These and other features and advantages of exemplary embodiments of the invention are described below with reference to the accompanying drawings, in which like reference numerals refer to components that are alike or similar in structure or function.

BRIEF DESCRIPTION OF THE DRAWINGS

FIG. 3 is an exploded perspective view of part of a drive side assembly for the structure in FIG. 1.

FIG. 4 is a cross-sectional view along line 4-4' in FIG. 3.

FIG. 7 is a photographic image of cylinders formed by techniques similar to that shown in FIG. 6.

FIG. 8 is a cross-sectional view of part of a drive side assembly for a variation of the structure in FIG. 1, taken along a line similar to line 4-4' in FIG. 3.

DETAILED DESCRIPTION

Figure 1:
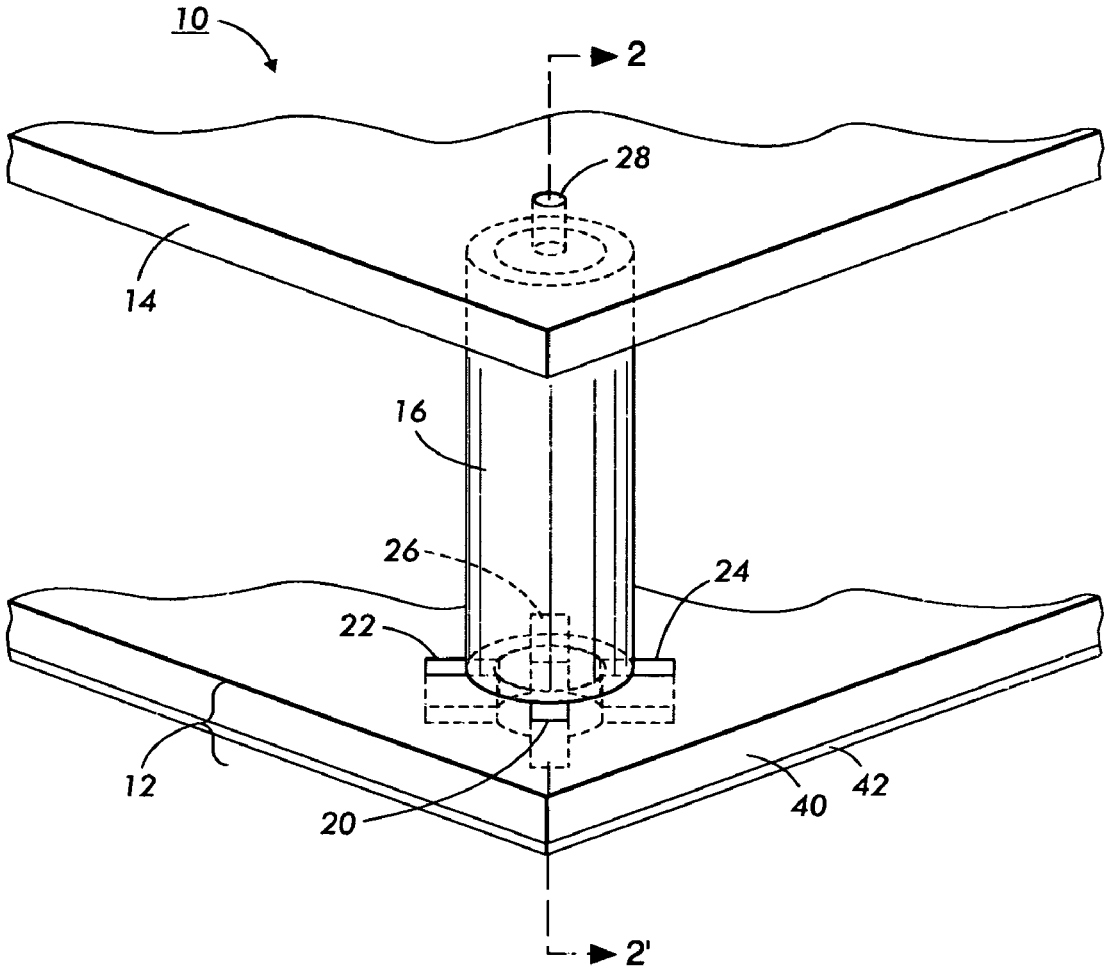
FIG. 1 is a perspective view showing features of a microfluidic structure in which a freestanding microtube is supported between two plate-like assemblies.

In the following detailed description, numeric ranges are provided for various aspects of the implementations described. These recited ranges are to be treated as examples only, and are not intended to limit the scope of the claims. In addition, a number of materials are identified as suitable for various facets of the implementations. These recited materials are to be treated as exemplary, and are not intended to limit the scope of the claims.

The terms "fluidic structure" and "channel" are used herein with related meanings: A "fluidic structure" is a structure that depends for its operation on fluid positioning or fluid flow, such as, for liquids or gases, in response to pressure or, for liquids, as a result of surface tension effects; a "channel" is any tube or other enclosed passage within a fluidic structure through which fluid flows during operation. In general, a "transverse cross-section" of a channel is a cross-section of the channel taken substantially perpendicular to fluid flow direction.

The related term "microfluidic structure" is used herein to mean a fluidic structure with at least one channel with a transverse cross-section that has a maximum inner dimension no greater than 1.0 mm. For example, if the transverse cross-section of the channel is approximately circular, the maximum inner dimension would be the maximum diameter.

The invention provides various exemplary embodiments, some of which include "microstructures", a term used herein to mean a structure with a maximum dimension less than 10 mm and with at least one outside dimension less than 1.0 mm. For example, a relatively large microstructure could be 5.0 mm high and 0.5 mm wide. In general, no minimum dimension is specified for microstructures, but specific materials, functional characteristics, or other constraints may require that a microstructure have at least some appropriate minimum dimension.

Various techniques have been developed for producing structures with one or more dimensions smaller than 1 mm. In particular, some techniques for producing such structures are referred to as "microfabrication." Examples of microfabrication include various techniques for depositing materials such as sputter deposition, evaporation techniques, plating techniques, spin coating, and other such techniques; techniques for patterning materials, such as photolithography; techniques for polishing, planarizing, or otherwise modifying exposed surfaces of materials; and so forth.

In general, the structures, elements, and components described herein are supported on a "support structure" or "support surface", which terms are used herein to mean a structure or a structure's surface that can support other structures; more specifically, a support structure could be a "substrate", used herein to mean a support structure on a surface of which other structures can be formed or attached by microfabrication or similar processes.

The surface of a substrate or other support surface is treated herein as providing a directional orientation as follows: A direction away from the surface is "up" or "over", while a direction toward the surface is "down" or "under". The terms "upper" and "top" are typically applied to structures, components, or surfaces disposed away from the surface, while "lower" or "underlying" are applied to structures, components, or surfaces disposed toward the surface. In general, it should be understood that the above directional orientation is arbitrary and only for ease of description, and that a support structure or substrate may have any appropriate orientation.

A structure or component is "directly on" a surface when it is both over and in contact with the surface. A structure is "fabricated on" a surface when the structure was produced on or over the surface by microfabrication or similar processes. A structure or component is "attached" to another when the two have surfaces that contact each other and the contacting surfaces are held together by more than mere mechanical contact, such as by an adhesive, a thermal bond, or a fastener, for example.

A process that produces a layer or other accumulation of material over or directly on a substrate's surface can be said to "deposit" the material, in contrast to processes that attach a part such as by forming a wire bond.

FIG. 1 shows microfluidic structure 10. Structure 10 includes drive side assembly 12, drop side assembly 14, and microtube 16, a tube-shaped microstructure that extends between assemblies 12 and 14 and has an inner cavity in which fluid can flow during operation. Structure 10 is therefore an example of a microfluidic structure in which fluid is driven from one side, referred to herein as a "drive side", through a substructure and is then ejected as drops at another side, referred to herein as a "drop side". Structure 10 accordingly includes drive side assembly 12 at its drive side and drop side assembly 14 at its drop side. As will be readily understood, however, the techniques described herein could be applied in various other types of structures, including examples with fluid flow in more than one direction, examples in which fluid is received rather than ejected, examples in which fluid is ejected in forms other than drops, and examples in which fluid flow is completely internal to a fluidic structure.

Microtube 16 is an example of a "ducting structure", meaning a structure or substructure through which fluid flows from one region to another. A channel for fluid flow from region to region is sometimes similarly referred to herein as a "duct". In the example in FIG. 1, microtube 16 has an inlet opening disposed toward assembly 12 and an outlet opening disposed toward assembly 14, and its internal cavity serves as a duct extending between the openings.

As illustrated, assemblies 12 and 14 are "plate-like structures," meaning that they resemble flat, thin pieces of material. Microtube 16 is "supported between" assemblies 12 and 14, meaning that microtube 16 is supported on or attached to each of assemblies 12 and 14 in such a way that it is held in place between them. Microtube 16 is also "freestanding", a term used herein to mean that it does not have any other support or attachment to hold it in place at any point along the length it extends between assemblies 12 and 14. In other words, even though microtube 16 may, for example, be fabricated on one of assemblies 12 and 14 and bonded or otherwise attached to the other of assemblies 12 and 14, it does not have any other support or attachment along its length. More generally, a structure that extends between two other components is "freestanding" if it has no other support or attachment holding it in place at any point except where it is adjacent to or contacts the two other components.

FIG. 1 also shows how assemblies 12 and 14 enclose or bound a space between them, and this space is sometimes referred to herein as a "plenum" in contexts in which it can be filled with a fluid that then flows into one or more ducting structures such as microtube 16. Except as otherwise noted, however, the techniques described herein are not limited to use of a plenum, but could also be applied to fluidic structures in which fluid flows into ducting structures from outside the structure rather than through a plenum.

Figure 2:
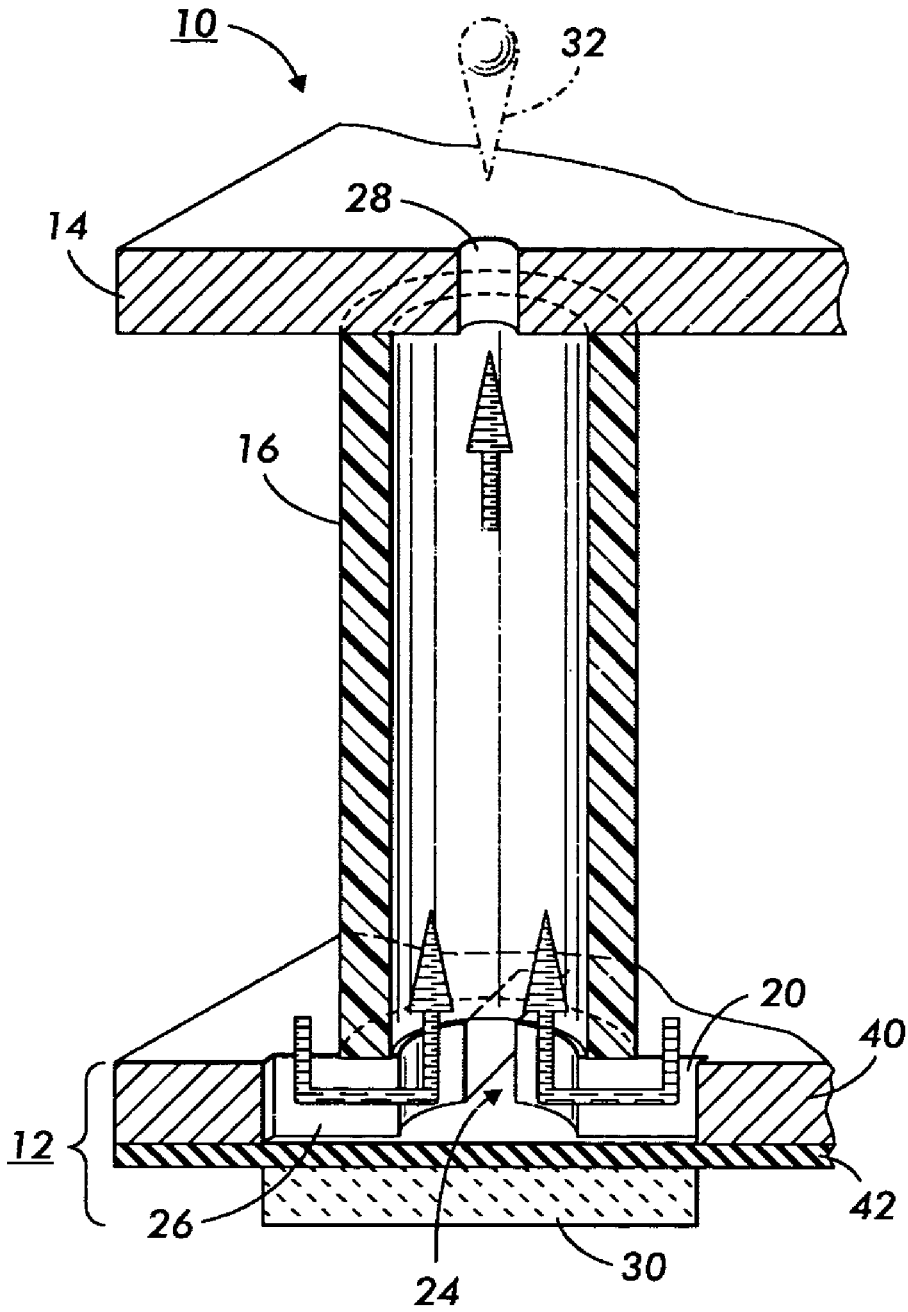
FIG. 2 is a cross-sectional view along line 2-2' in FIG. 1.

FIG. 2 shows a schematic cross-section along the line 2-2' in FIG. 1. Together, FIGS. 1 and 2 illustrate how fluid from within the space bounded by assemblies 12 and 14 may flow into the inlet opening of microtube 16. Specifically, assembly 12 has recesses 20, 24, and 26 defined in its surface, allowing fluid to flow under the lower boundary of microtube 16 and through the inlet opening. After flowing under the lower boundary, fluid enters a duct defined within microtube 16. In the implementation shown in FIGS. 1 and 2, the duct is a straight cylindrical cavity, but the duct could take any appropriate shape between the inlet and outlet openings, and a single microstructure could include more than one such duct.

After being received from assembly 12 through the inlet opening, fluid can flow in the duct within microtube 16 until it is provided to assembly 14 through the outlet opening. In the illustrated implementation, drop side assembly 14 has an aperture 28 defined in it so that drops of fluid can pass through and be ejected from assembly 14.

Microfluidic structure 10 can, for example, be implemented to emit drops of fluid through aperture 28 in response to actuator 30 in assembly 12, positioned under microtube 16. Actuator 30 can be controlled to cause fluid to flow through the duct in microtube 16 and be expelled through aperture 28, illustratively producing drop 32. Actuator 30 can be any mechanical or electromechanical device capable of causing fluid to flow or otherwise move as described and could, for example, be implemented as a thin film piezoelectric transducer, a bubble generator, or another appropriate actuator that can provide time-varying mechanical pressure, and can be circular, square, or any other suitable shape.

Actuator 30 and neighboring regions of plates 40 and 42 define a diaphragm structure. The neighboring region of plate 40 serves as a support that defines a boundary around a diaphragm. The region of plate 42 inside the boundary, i.e. where plate 40 has been etched away, serves as a diaphragm at the base of a compression chamber that extends through microtube 16. In general, the term "compression chamber", or simply "chamber", is used herein to refer to a chamber within which fluid may receive varying mechanical pressure, such as from an actuator; both compression and decompression would occur in a compression chamber. In the implementation in FIG. 2, actuator 30 provides the vibrational energy to drive the diaphragm, causing pulsed or periodic up and down movement of the region of plate 42, providing mechanical pressure to fluid in the compression chamber.

Microtube 16 illustratively has a circular central cavity of approximately uniform diameter extending its full length, and the cavity's maximum dimension perpendicular to the microstructure's length is therefore the microstructure's inner diameter. The inner diameter is illustratively significantly less than the length. In FIG. 2, the length is at least approximately two times the diameter, and is approximately four times the diameter of the cavity. This and other examples described herein illustrate how the possibility of choosing a length-to-diameter ratio of two or more provides greater design flexibility. In other words, a microstructure can be obtained with a central cavity having a desired ratio of length to maximum dimension perpendicular to length, and consequently with certain fluidic characteristics. This flexibility makes it possible to obtain a greater variety of fluidic structures.

FIG. 3 shows portion 50 of drive side assembly 12, illustrating how assembly 12 could be fabricated. Portion 50 includes part of stainless steel plate 42, on the opposite side of which is actuator 30. Portion 50 also includes part of stainless steel plate 40, chemically etched to provide a cross shape with recesses 20, 22, 24, and 26, as well as an open circular central area 56 that is adjacent plate 42 opposite actuator 30.

To fabricate drive side assembly 12, plate 40 can be separately etched. Then, plates 40 and 42 can be aligned, clamped, and brazed or otherwise bonded to form drive side assembly 12. Actuator 30 could then be transferred to the exposed surface of plate 42 and epoxied or otherwise attached. The inlet fluid path illustrated in FIGS. 1 and 2 is determined from the dimensions of recesses 20, 22, 24, and 26; from the thickness of plate 40, which determines depth of the recesses; and from the radius of microstructure 16, which determines overlap with the recesses. Plates 40 and 42 could be stainless steel or other suitable metal or non-metal material with the thickness of shim stock, such as approximately 0.5-10.0 mils (12.5-250 μm). These dimensions can be chosen to optimize operation of structure 10, and also to minimize tolerance and critical feature issues.

FIG. 4 shows a cross-section of portion 50 after fabrication, taken along the bent line 4-4' in FIG. 3. As shown, actuator 30 is on surface 58 of plate 42. In addition, actuator 30 receives electrical signals from a driver (not shown). Actuator 30 can, for example, be implemented with a conventional ceramic piezoelectric material ("piezoceramic") such as lead-zirconate-titanate (PZT). Actuator 30 could be driven with conventional signals used to drive piezoceramic actuators. Techniques for producing and driving piezoceramic actuators are described, for example, in U.S. Pat. Nos. 6,805,420; 6,803,703; 6,739,704; 5,170,177; and 5,155,498, each of which is incorporated herein by reference. The structure shown in FIG. 4 thus provides a diaphragm pump at the end of a compression chamber. In the illustrated implementation, the compression chamber is barrel-shaped but could have any other suitable shape. With actuator 30 vibrating at an appropriate fixed frequency, each period of vibration will produce a droplet through aperture 28.

In the implementation of FIGS. 1-4, drive side assembly 12 includes two plates, but other structures could be used. For example, an additional layer or plate could be added between plates 40 and 42, etched to define a diaphragm structure forming a boundary around the region of plate 42 that can move up and down. Furthermore, plate thicknesses and other dimensions could be adjusted and layers could be added to obtain desired diaphragm behavior. In general, however, in this and other implementations, it is desirable to reduce the number of different layers and plates.

Figure 5:
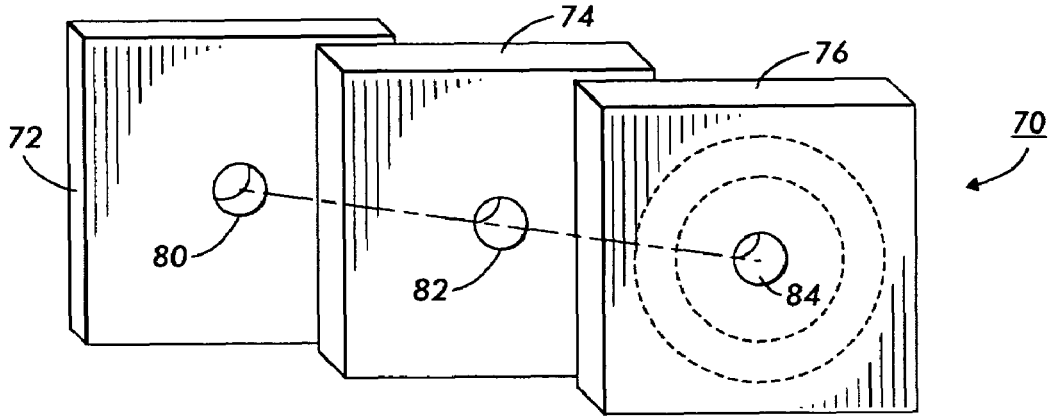
FIG. 5 is an exploded perspective view of part of a drop side assembly for the structure in FIG. 1.

FIG. 5 shows portion 70 of drop side assembly 14. Portion 70 includes parts of stainless steel plates 72, 74, and 76. Plate 72 can be a high-grade aperture plate with aperture 80 formed to a precise size. Plates 74 and 76 can be backing plates in which apertures 82 and 84, respectively, are formed less precisely. Together, apertures 80, 82, and 84 form aperture 28 as shown in FIGS. 1 and 2. Plates 74 and 76 provide stiffness to drop side assembly 14.

Apertures 80, 82, and 84 can be formed in plates 72, 74, and 76, respectively, by etching or by any appropriate mechanical technique. After the apertures are formed, the plates can then be aligned, clamped, and brazed or otherwise bonded to form drop side assembly 14. As shown in the dashed outline, microstructure 16 is subsequently fabricated on or attached to the exposed surface of plate 76, around aperture 84.

Figure 6:
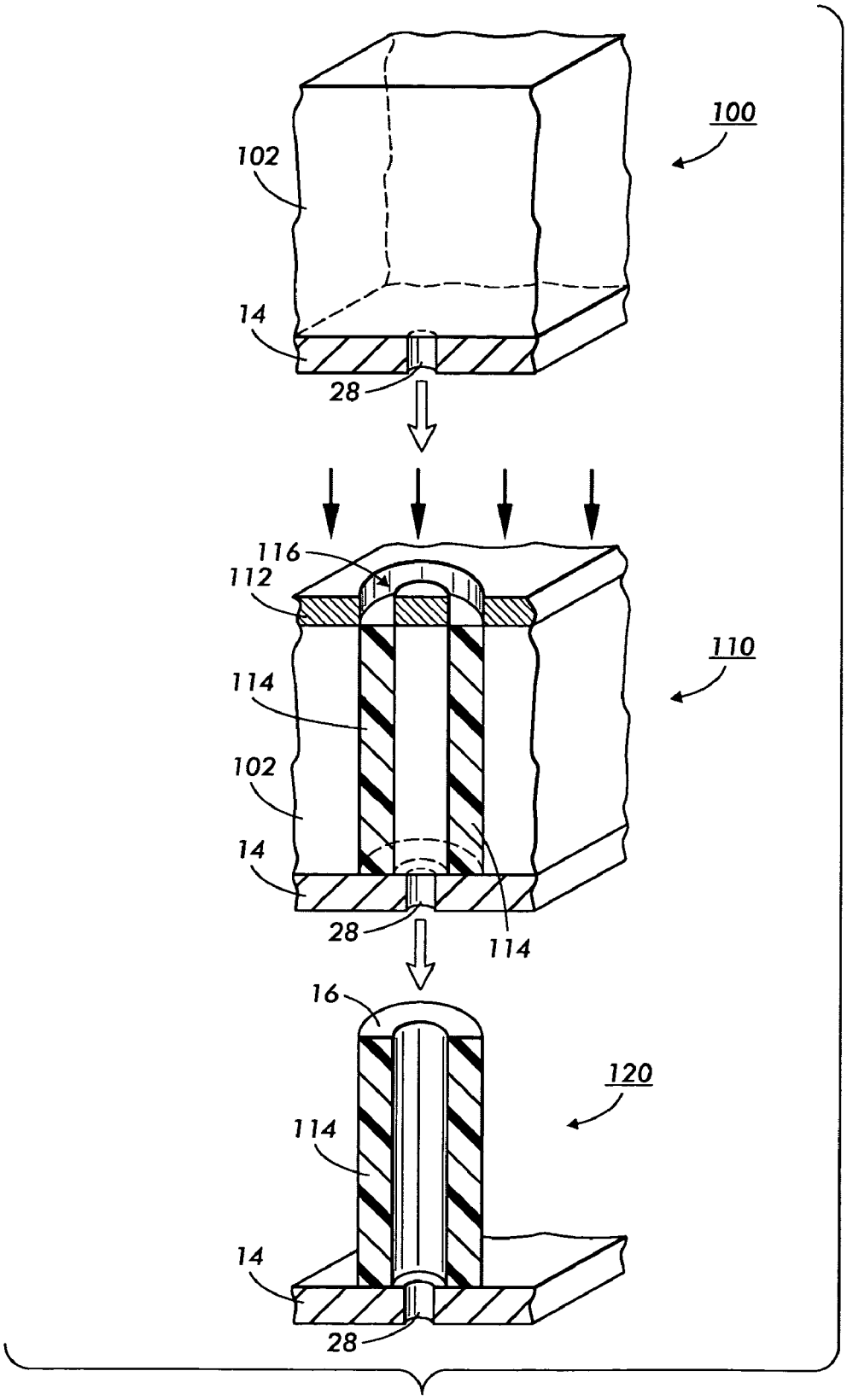
FIG. 6 is a series of cross-sectional views showing stages in producing a microstructure on a drop side assembly for a structure like that in FIG. 1.
Figure 13:
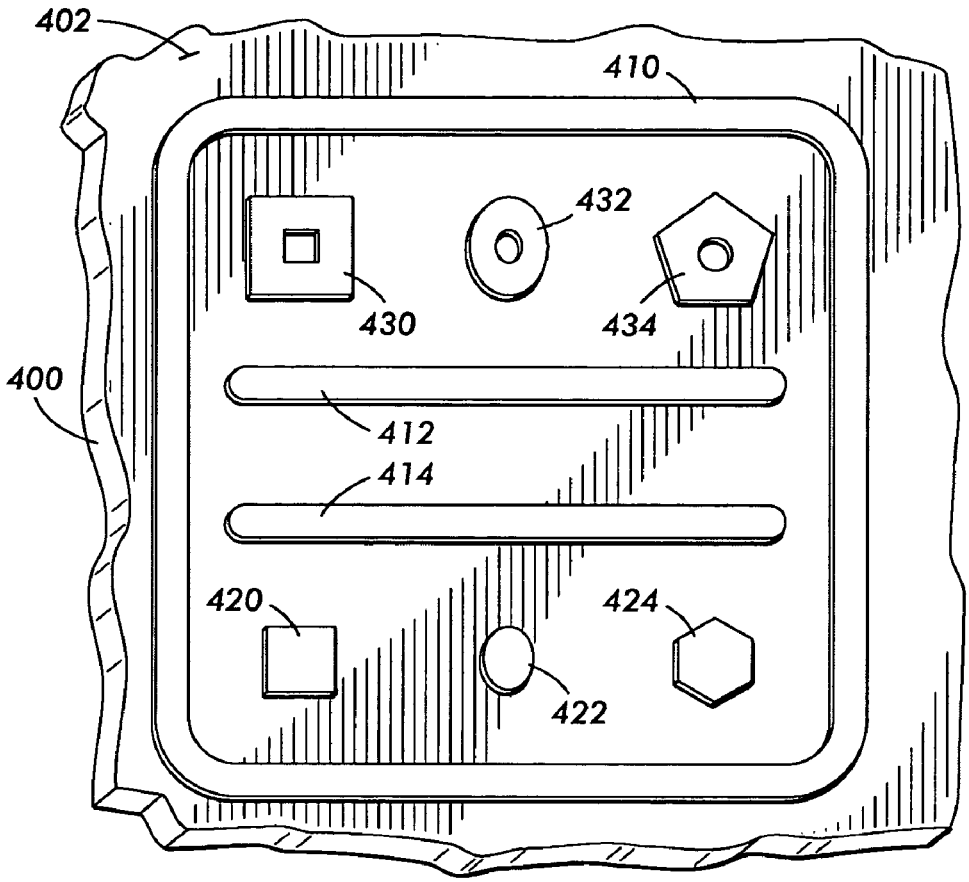
FIG. 13 is a top view of a number of polymer structures on a substrate.

FIG. 6 shows a sequence of three cross-sectional views, each showing a stage during fabrication of microstructure 16 on drop side assembly 14, but illustratively with microstructure 16 having different dimensions than in FIG. 2 such that the ratio of its length to its inside diameter is approximately five. Microstructure 16 is illustratively a microtube formed photolithographically from a layer of photoresist, but could instead have any other suitable shape and could in general be formed in any other suitable manner from any appropriate material, such as by embossing, molding, laser ablation, deep silicon etching, and so forth. Examples of some other shapes are illustrated in FIG. 13, below.

The implementation at FIG. 6 illustrates an example of how a structure can be "photo-defined" from a "photoimageable structure." A "photoimageable structure" is a layer, a series of layers, or another structure of photoresist or other material that can be patterned by selectively exposing the structure to radiation with appropriate characteristics and then removing exposed or unexposed regions. A structure could be selectively exposed in various ways, including exposing it through a mask, as illustrated in FIG. 6, or by selectively scanning it.

As used herein, a structure is "photo-defined" if it is produced by a process that uses radiation to define the structure's shape and dimensions. For example, a technique could selectively expose a layer of photoresist or other photoimageable structure, then process it to remove exposed or unexposed regions. A structure could also be photo-defined without a photoimageable structure, such as by using a laser beam or other intense radiation to produce a shape, as in laser ablation.

In cross-section 100, layer 102 of a photoimageable polymer has been deposited on the surface of drop side assembly 14 to an appropriate depth, providing an example of a photoimageable structure. The photoimageable polymer could, for example, be SU-8 from MicroChem Inc. or another suitable negative photoresist. SU-8 is especially well suited for microstructures greater than 100 μm in length; for shorter microstructures, other negative photoresists such as NR9-8000 (from Futurrex, Inc.) or positive photoresists such as AZPLP-100 (from Clariant Corporation) could be used.

If aperture 28 is formed before deposition of layer 102, as shown, appropriate measures can be taken to prevent leakage of material from layer 102 through aperture 28. For example, assembly 14 can be bonded onto another, more rigid carrier substrate such as glass, using a suitable bonding technique such as double-sided adhesive tape; in this case, the carrier substrate closes the bottom of aperture 28 and could be released before or after further processing by using ultraviolet light to weaken the adhesive so that assembly 14 with layer 102 can be peeled away. Alternatively, an adhesive tape alone or another material such as polyvinyl alcohol or another highly viscous acqueous adhesive material bonded to assembly 12 may prevent leakage, or the material in layer 102 could be sufficiently viscous and aperture 28 sufficiently small to prevent leakage. Another possibility is to plug aperture 28 with cross-linked material that is not removed with layer 102 but can be subsequently removed. Also, layer 102 could be deposited before aperture 28 is formed.

Layer 102 may be deposited by a spin-on process or any other appropriate process, such as liquid extrusion, doctor blading, and dip coating. Acceleration, final spin speed, spin duration, and viscosity of resin can be adjusted to obtain a desired thickness of layer 102. Multiple coatings, with a softbake between coatings, may be applied in order to obtain a thicker layer of SU-8. After layer 102 is coated onto assembly 14, a softbake can be performed to evaporate solvent and harden layer 102. A controlled hotplate can be used to ramp the temperature during the bake. Precise leveling of the hotplate can be important to maintain good thickness uniformity of the SU-8 layer during softbake.

In cross-section 110, mask 112 is positioned on layer 102 and includes an annular opening 116. Therefore, mask 112 prevents exposure of the photoimageable polymer in layer 102 except in region 114 under opening 116, a photo-exposed region that has the shape of the desired microstructure; region 114 is illustratively tubular, but could have another suitable shape.

Photoimageable polymer in layer 102 can be selectively exposed through mask 112 using a contact aligner with an i-line (365 nm) illumination source. If the photoimageable polymer is SU-8, for example, exposure will cause the photoinitiator to generate a photoacid. Then, a post-exposure bake can be performed, causing the photoacid to act as a catalyst for cross-linking in the exposed areas.

Mask 112 can be any appropriate structure, such as a standard chrome mask, formed by depositing and patterning a masking layer or releasably formed on a substrate and mechanically applied to the upper surface of layer 102. After exposure, mask 112 can be removed, such as by a selective solvent, and layer 102 can then be developed.

Cross-section 120 shows the result of developing layer 102 where the photoimageable polymer is SU-8 or another negative photoresist. As shown, tubular exposed region 114 remains after development and removal of unexposed regions, providing an example of a photo-defined structure.

With SU-8, for example, developers such as propylene glycol monomethyl ether acetate (PGMEA) or gamma butyrolactone (GBL) can be used. The developers dissolve unexposed, non-cross-linked areas, leaving only exposed region 114. If layer 102 is a thick layer of SU-8 and microstructure 16 has a high aspect ratio, a long development time may be required. Spray development can be used to speed up the process and produce microstructures with higher aspect ratios, but fragile microstructures could be destroyed by such a process. Similar considerations apply to development in an ultrasonic bath. After development, residues can be rinsed away with an appropriate solvent, such as isopropanol.

After development, further processing can be performed as appropriate to the photoimageable polymer used. For SU-8, for example, an additional hardbake at temperatures above 100° C., such as 200° C., can make the resulting microstructure more resistant to chemicals. The hardbake can be used to cure out microcracks that normally occur after development, but also increases shrinkage of SU-8 due to more complete cross-linking.

After fabrication of microstructure 16 as in FIG. 6, drive side assembly 12 can be attached to the top end of microstructure 16, producing microfluidic structure 10 as in FIGS. 1 and 2. If microstructure 16 is made of SU-8, for example, a thin layer of SU-8 or an adhesive could be deposited, such as by carefully roll-coating or stamping the SU-8 or adhesive either onto the top surface of microstructure 16 or onto the surface of drive side assembly 12. Drive side assembly 12 could then be placed onto the top end of microstructure 16 (or onto the top ends of an array of microstructures). The thin layer of SU-8 or adhesive could then be cured such that drive side assembly 12 adheres to already hardened SU-8 in microstructure 16.

As discussed in greater detail below, microstructure 16 can be one of an array of nearly identical microstructures, such as in a printhead application. FIG. 7 shows an array of cylinders of SU-8 photoresist produced similarly to the technique illustrated in FIG. 6, on a stainless steel substrate similar to drop side assembly 14, showing the feasibility of producing an array of microstructures of this type. The illustrated cylinders are all of approximately equal length, 600 μm, with an outer diameter of approximately 300 μm. SU-8 cylinders have been successfully produced with various other dimensions, for example, 862 μm in length with outer diameters of 294 μm at the base and 324 μm at the top, and also approximately 620 μm in length with outer diameters of 345 μm at the base and 367 μm at the top Various other microstructure sizes and shapes could be produced using substantially the same techniques described above, but with different masks during patterning of photoimageable polymer layers of appropriate thicknesses. For example, rather than circular structures with circular cavities as in the above illustrations, the structures or cavities could be oval, square, rectangular, or with any other polygonal shape. In addition, plating over polymer molds could be performed in producing the microstructures, which could include polymer components, plated components, or both, as described in co-pending, co-assigned U.S. patent application Ser. No. 11/014,357, which is incorporated herein by reference in its entirety.

Figure 9:
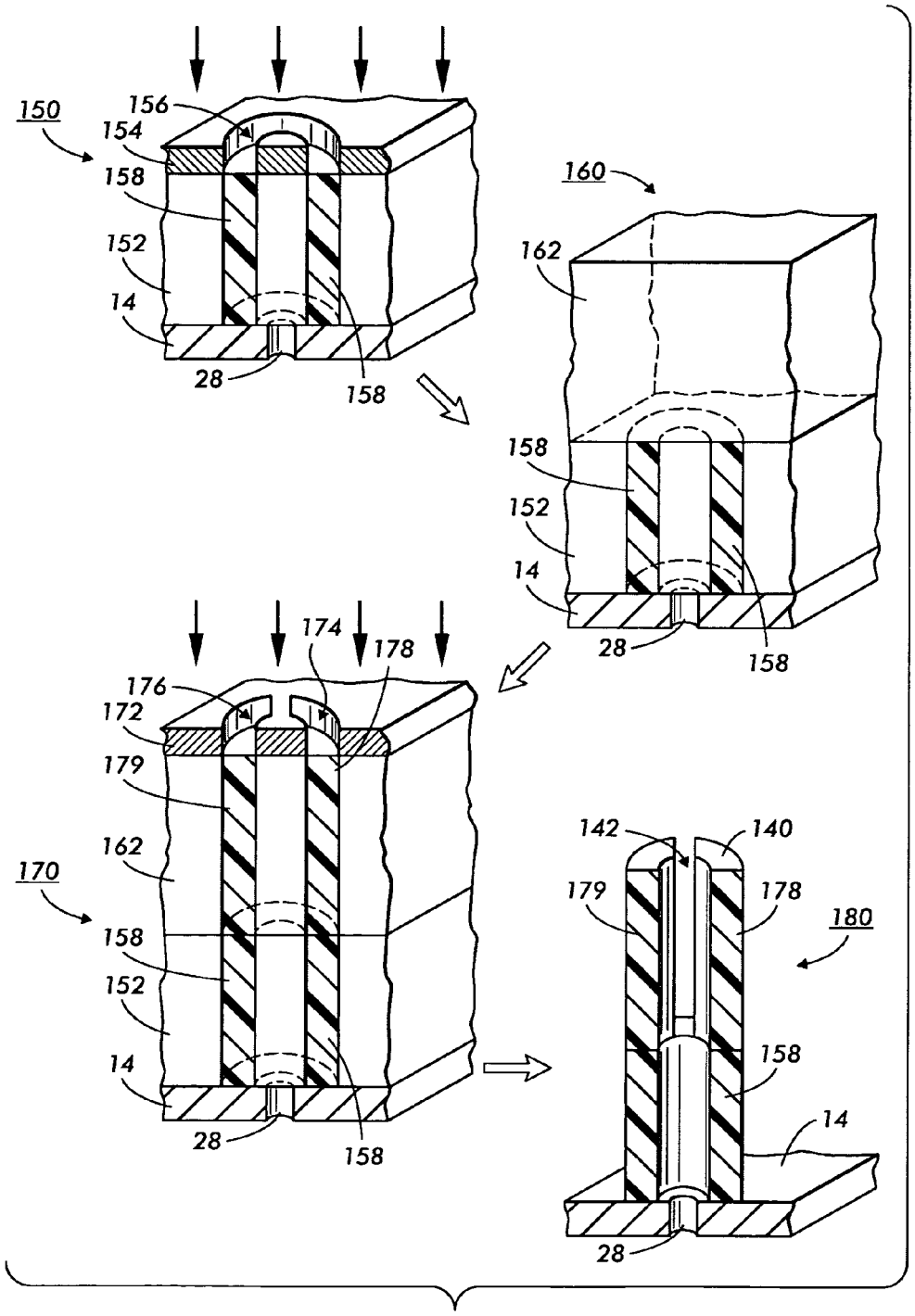
FIG. 9 is a series of cross-sectional views showing stages in producing a microstructure on a drop side assembly for a structure like that in FIG. 8.

Rather than etching stainless steel plates to provide recesses or apertures for fluid flow into and out of the end openings of microstructure 16, one or more lateral openings for fluid flow could be provided in a wall of a microstructure. FIGS. 8 and 9 illustrate modifications of the implementation described in relation to FIGS. 1 to 7. In this modification, the microstructure has a pair of grooves or slots allowing fluid flow into its interior near rather than from a drive side assembly.

FIG. 8 shows portion 130, including microstructure 140 and a region of a drive side assembly for the modified implementation. As in FIG. 4, portion 130 includes plate 42 and actuator 30, with plate 42 sufficiently thin that it can be bent by actuator 30 in operation to provide up and down movement. In this implementation, however, plate 40 (FIG. 3) is not present, and microstructure 140 can be in direct contact with plate 42. As shown in FIG. 8, microstructure 140 has slot or groove 142, illustratively extending approximately half of its length, although it could extend any suitable portion of the length. The counterpart slot, symmetrically located in microstructure 140 opposite slot 142, is not shown.

Microstructure 140 also illustrates another example of a feature discussed above. Like microstructure 16 in FIG. 2, microstructure 140 has a central cavity extending its full length, and the cavity's maximum dimension perpendicular to the microstructure's length is a diameter that is significantly less than the length. In FIG. 8, the length is at least approximately two times the diameter, and is approximately three times the diameter of the cavity. As explained above, the availability of length-to-diameter ratios of two or more provides greater design flexibility, making it possible to obtain a greater variety of fluidic structures.

FIG. 9 shows a sequence of cross-sections during fabrication of microstructure 140 as in FIG. 8, but illustratively with different dimensions such that the ratio of its length to its inside diameter is approximately eight. As in FIG. 6, above, microstructure 140 is fabricated on drop side assembly 14 in which aperture 28 has previously been formed. Except as noted below, operations in FIG. 9 can be performed generally as described above in relation to FIG. 6.

Cross-section 150 is similar to cross-section 110 in FIG. 6, except that the photoimageable structure, layer 152 of photoimageable polymer, is only approximately half the length of the desired microstructure. As in cross-section 110, mask 154 over layer 152 has annular opening 156. Therefore, during selective exposure with mask 154, only tubular region 158 in layer 152 is exposed.

In cross-section 160, layer 162 of a photoimageable polymer such as SU-8 has been deposited on the surface of layer 152 to an appropriate depth, with layers 152 and 162 together being approximately equal to the total length of the desired microstructure. Together, layers 152 and 162 provide a photoimageable structure within which region 158 has already been exposed.

In cross-section 170, mask 172 is positioned on layer 162 and therefore prevents exposure of photoimageable polymer in layers 152 and 162 except through C-shaped openings 174 and 176. As a result of selective exposure through mask 172, C-shaped regions 178 and 179 in layer 162 are exposed, and portions of region 158 in layer 152 receive additional exposure.

After removal of mask 172, development, and other appropriate processing, microstructure 140 remains, as shown in cross-section 180, providing another example of a photo-defined structure. Slot or groove 142 extends approximately half the length of microstructure 140, separating C-shaped regions 178 and 179, both of which are on top of annular region 158.

As with the implementation in FIGS. 1-7, the implementation of FIGS. 8 and 9 could be modified in various ways. For example, layers could be added and dimensions adjusted to obtain desired diaphragm behavior. Lateral openings, slots, or grooves as in FIGS. 8 and 9 could be produced in microstructure 16 (FIG. 6) in other ways, such as by laser ablation or other etching techniques. Also, the number, shapes and dimensions of lateral openings could be changed, and the lateral openings could be provided for fluid flow out of a microstructure near a plate-like structure rather than into the microstructure. More generally, a microstructure or other ducting structure extending between two plate-like structures can receive fluid through an opening from or near one plate-like structure and can provide fluid through an opening to or near the other.

Figure 10:
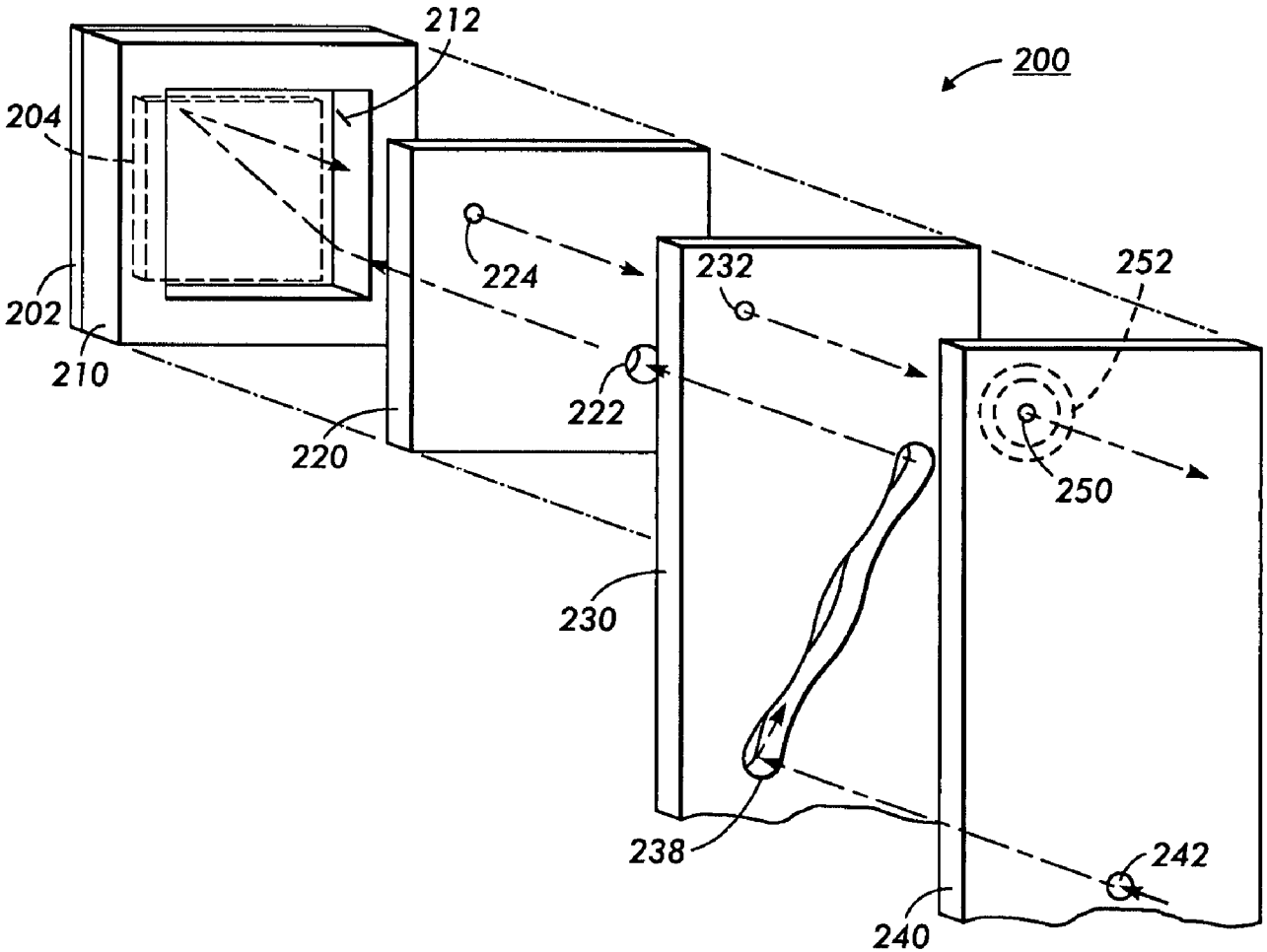
FIG. 10 is an exploded perspective view of part of a drive side assembly for another variation of the structure in FIG. 1.

Whether fluid flows through recesses in drive side assembly 12 as in FIGS. 1 and 2 or through slots or grooves as in FIGS. 8 and 9, the fluid can return back to the space between drive side and drop side assemblies 12 and 14, resulting in uneven flow. Such recesses and slots or grooves are too short to work as check valves. FIG. 10 illustrates features of another implementation, in which a drive side assembly includes extended recesses that behave like check valves, preventing fluid from reversing its forward flow into a compression chamber.

FIG. 10 shows portion 200 of the drive side assembly, illustrating how the assembly could be fabricated. Portion 200 includes part of stainless steel plate 202, on the reverse side of which is actuator 204, shown in dashed outline; actuator 204 is shown as square but could have any suitable shape. Portion 200 also includes part of stainless steel plate 210, chemically etched to provide a square compression chamber 212 that is adjacent plate 202 opposite actuator 204. Plate 202 acts as a diaphragm, pumping fluid through compression chamber 212. The thickness of chamber 212 is the same as that of plate 210, which is also sufficiently thick to serve as a diaphragm support at the boundary of a region of plate 202 that serves as a diaphragm. For example, plate 202 could be 1 mil (25.4 μm) thick and plate 210 could be as thick or thicker than plate 202.

Next to plate 210, portion 200 includes part of stainless steel plate 220, chemically etched to have two openings into compression chamber 212. Inlet opening 222 is illustratively shown near one corner of chamber 212, while outlet opening 224 is illustratively shown near the diagonally opposite corner of chamber 212. As will be seen, outlet opening 224 is aligned with the center of microstructure 16.

Next to plate 220, portion 200 includes part of layer 230, which could be stainless steel or another material that can be formed on a surface and patterned, such as SU-8 or another photoimageable polymer. Layer 230 has been chemically etched or otherwise patterned to have outlet opening 232 and inlet duct 238. Outlet opening 232 is aligned with outlet opening 224 in plate 220.

Inlet duct 238, because of its dimensions, shape, and impedance, behaves like a check valve, preventing fluid flow from reversing direction once forward flow has been established through duct 238 into inlet opening 222 in plate 220. Compression chamber 212 can be one of a two-dimensional array of compression chambers, in which case duct 238 illustratively has a length that would extend across approximately two adjacent compression chambers. To avoid overlap by meandering around outlet openings and inlet ducts for other chambers, duct 238 has a long, narrow shape, with sides that alternately widen and narrow along its length. In general, however, duct 238 could have any suitable dimensions and shape appropriate to the fluid and actuator frequency to be used, in accordance with known techniques for controlling fluid flow.

Next to plate 230, portion 200 includes part of stainless steel layer 240, chemically etched to have inlet opening 242 and outlet opening 250. Outlet opening 250 is aligned with outlet opening 232 in layer 230 and outlet opening 224 in plate 220. Openings 224, 232 and 250 can be dimensioned and aligned for optimal fluid flow; for example, openings 224 and 232 can be larger than opening 250 to provide alignment tolerance, but all three can be within the projection of microstructure 16, positioned as shown by dashed outline 252. Similarly, inlet opening 242 is aligned and dimensioned to provide fluid flow into inlet duct 238.

In operation, portion 200 provides an upstream fluid path into compression chamber 212 and a downstream fluid path out of compression chamber 212, continuing through microstructure 16 and an aperture in a drop side assembly as described above. The upstream path includes opening 242, inlet duct 238, and opening 222. The downstream path includes a segment within the drive side assembly, including openings 224, 232, and 250 as well as the central cavity of microstructure 16 and the aperture in the drop side assembly. The parts of each of these fluid paths, taken together, will have a respective impedance that includes both a resistance component and an inertia component. To prevent fluid flow from reversing, the upstream path can have an impedance ("upstream impedance") that exceeds that of the downstream path ("downstream impedance"), such as by a ratio of at least approximately 2:1. Inlet duct 238 can be shaped and dimensioned to provide most of the upstream impedance, and, in an array, the inlet ducts can be designed to provide sufficient upstream impedance to overcome the effect of small variations in downstream impedance between different elements in the array.

To fabricate the drive side assembly, plates 210, 220, and 240 and layer 230 can be separately etched; layer 230, for example, can either be a separate etched plate or a layer deposited and patterned on plate 220 or on plate 240. All plates and layers can then be aligned, clamped, and bonded to form the drive side assembly. Adjacent plates can be brazed, for example, while a plate and an adjacent polymer layer can be bonded by an adhesive.

Once fabricated, the drive side assembly can be attached to the top end of microstructure 16 (or to the top ends of an array of similar microstructures) in the manner described above in relation to FIG. 6. Microstructure 16 can be positioned as shown by dashed outline 258 around outlet opening 250, so that openings 224, 232, and 250 are all aligned with the center of microstructure 16. Or microstructure 16 could be fabricated on the exposed surface of plate 240 and a drop side assembly could then be attached.

Actuator 204 can also be subsequently transferred to the exposed surface of layer 202 and epoxied or otherwise attached. Actuator 204 can similarly be one of an array of actuators that are concurrently transferred and attached.

In operation of a microfluidic structure with a drive side assembly that includes portion 200, fluid flows through inlet opening 242 into duct 238, and exits from duct 238 through inlet opening 222 into compression chamber 212. Within compression chamber 212, actuator 204 provides pulses that cause fluid to be expelled through outlet openings 224, 232, and 250 and into microstructure 16. In addition to the dimensions and shape of duct 238, discussed above, other factors that play a role in fluid flow through the drive side assembly include the thicknesses of plates and layers, the dimensions of inlet and outlet openings and of the compression chamber, characteristics of the fluid and of actuator 204, the radius of microstructure 16, and so forth, and all of these factors can be selected and coordinated to obtain desired operating characteristics.

Microfluidic structures like those described above have a wide range of applications. The following-described printhead application is exemplary and illustrates features of such structures that could be employed in various other applications involving, for example, biotechnology, industrial processing, and fluidics control; in general, the term "printhead application" is used herein to refer to any application in which a fluid is transferred from a structure holding or containing the fluid (the "printhead") onto a target such as a sheet of paper or other material or a surface of a substrate or other structure on which fluid is deposited. Fluidic structures could be used not only in printing and other printhead applications, but also in biological fluid manipulation, microfluid manipulation, flow meters, flow controllers, medical equipment, processing equipment, and so forth.

Figure 11:
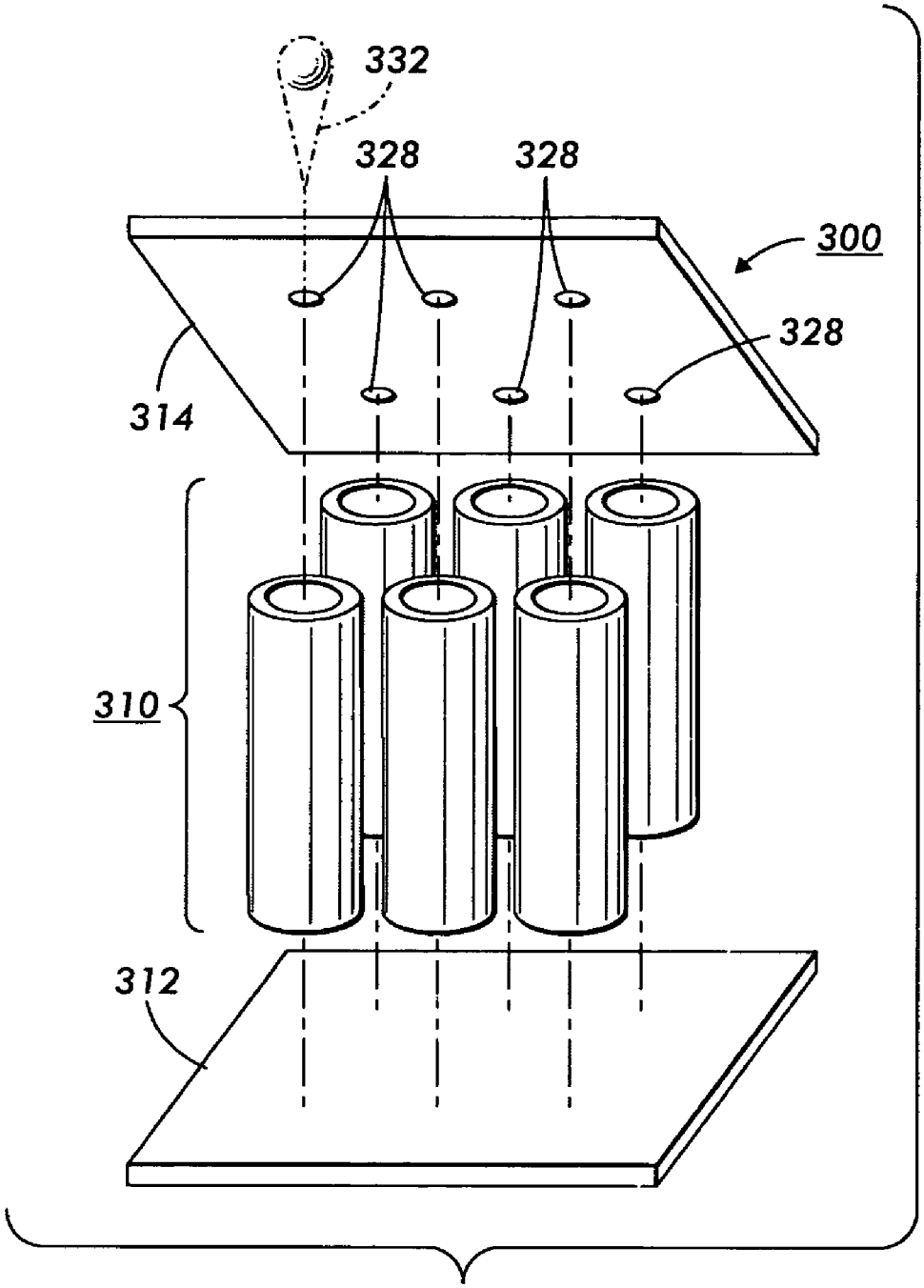
FIG. 11 is an exploded perspective view showing features of a microfluidic structure in which microstructures in an array are supported between plate-like assemblies.

FIG. 11 shows an exploded view of a microfluidic structure 300 that could be produced as described above in relation to any of the implementations in FIGS. 1-10 and could be used as a printhead core. An array 310 of microstructures can be concurrently fabricated on one of drive side assembly 312 or drop side assembly 314, with all the microstructures in array 310 having substantially the same length. A wall-like perimeter seal (not shown) with a width substantially the same as the length of the microstructures can also be fabricated or attached around the perimeter of array 310. Then, the other assembly can be bonded on the top ends of the microstructures and the perimeter seal. As illustrated by apertures 328, assemblies 312 and 314 can each have apertures, openings, or other features formed before or after other processes. Each microstructure in array 310 thus provides an ejector by receiving ink or another appropriate fluid from a plenum between assemblies 312 and 314 in one of the ways described above and by providing ink or other fluid through a respective aperture 328 in drop side assembly 314 with which it is aligned as suggested by droplet 332.

When considered with FIGS. 1 and 2, above, for example, structure 300 provides two regimes for fluid flow. Inside each microstructure, fluid flows under control of an actuator, such as a piezoelectric element that moves a diaphragm. Movement of the diaphragm causes a pressure pulse, in turn causing droplet 332 to eject from respective aperture 328 at the other end of the microstructure's duct. Outside the microstructures, in the plenum between assemblies 312 and 314 and bounded by the perimeter seal, fluid flows relatively slowly at low resistance to resupply fluid ejected from microstructure ducts.

The plenum will be especially effective if there is substantial open space between microstructures in array 310, which is possible if the microstructures are freestanding and do not have any support or other occlusions around them as shown in FIG. 11. Ideally, fluid is evenly distributed within the plenum and, as a result, throughout the printhead core. The plenum may also provide volumetric compliance to dampen acoustic noise or cross-talk that could otherwise travel from one actuator to another, as can be problematic in stainless steel printheads.

In the illustrated implementation of structure 300, each microstructure in array 310 is a microtube. The microtubes can be fabricated from SU-8 as described above, and assemblies 312 and 314 can each include stainless steel plates as described above. A piezoelectric diaphragm actuator (not shown) for each microtube can be positioned on the surface of assembly 312 opposite the microtube, and can be driven to cause fluid ejection from the microtube through the respective aperture 328 in assembly 314.

Dimensions of microtubes in array 310 can be appropriate for the fluid ejection technique employed and the performance desired, such as ejection efficiency and refill time. In general, increasing microtube length will increase the volume of the plenum region outside the microtubes and allow more fluid to flow around the microtubes, allowing more individual ejectors. But increased length will also increase fluid capacitance and impedance of each microtube's interior. Similarly, reducing the inside diameter of each microtube reduces fluid volume, therefore usually reducing capacitance and increasing impedance. And increasing nozzle density (and therefore microtube density) will reduce the volume of the plenum region.

Exemplary microtube dimensions could be length of 500 μm, outside diameter of 300 μm, and inside diameter of 200 μm, with 900 nozzles per square inch (139.5 nozzles per $cm^2$). Microtubes with approximately these dimensions have been successfully produced using techniques as described above, and it appears practicable to allow approximately 850 μm between adjacent microtube centers and an overall thickness of 1250 μm, including both microtube length and also thicknesses of both assemblies 312 and 314.

In some applications, SU-8 may degrade over time, such as with printhead operating temperatures around 150° C. Or structural failure may occur, such as if SU-8 polymer does not adhere to a stainless steel substrate or due to difference in thermal expansion coefficient between the polymer and steel. In such applications, SU-8 microtubes as in FIG. 11 could be metal plated such as with nickel or gold. Metal plated microtubes on stainless steel should resist degradation and maintain adhesion better than polymer microtubes. Also, stress would be less of a problem because of smaller differences in thermal expansion coefficients between the metal tubes and the stainless steel substrates.

In addition, structure 300 could be implemented with metal microtubes formed as described in co-pending, co-assigned U.S. patent application Ser. No. 11/014,357, which is incorporated herein by reference in its entirety.

Figure 12:
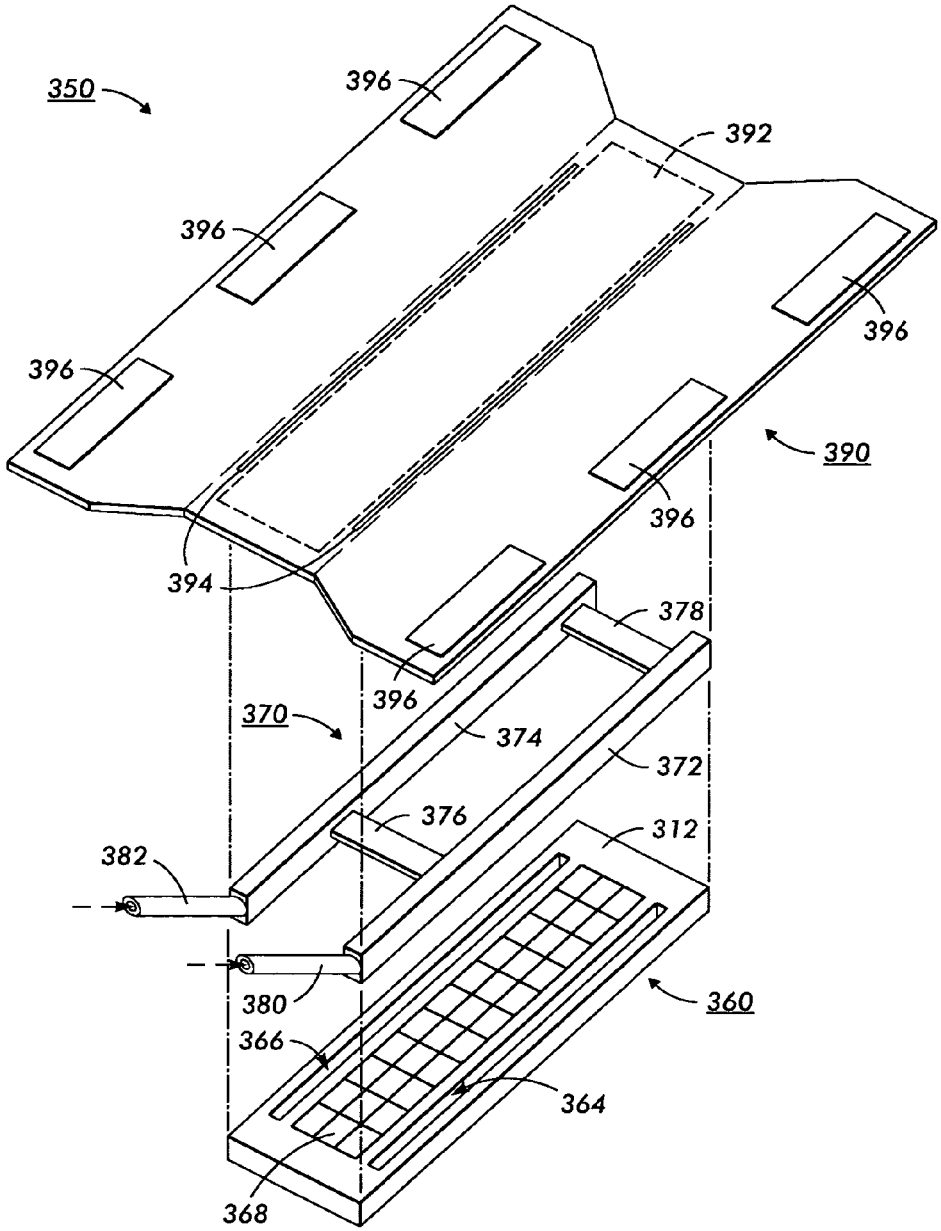
FIG. 12 is an exploded perspective view of components of a printhead that includes a microfluidic structure as in FIG. 11.

FIG. 12 shows an exploded view of printhead 350 with a core that is an example of microfluidic structure 300 in FIG. 11. Printhead 350 includes components for manifold distribution of ink or other fluid into a plenum and for electrical interconnection with actuators.

Printhead core structure 360 is shown with drive side assembly 312 of microfluidic structure 300 upward, so that drop side assembly 314 and array 310 of microstructures are below assembly 312 and therefore not visible in FIG. 12. Droplets of fluid would be ejected through apertures on the downward-facing surface of core structure 360.

Drive side assembly 312 has fluid distribution openings 364 and 366 defined in it, allowing fluid to flow into the plenum between assemblies 312 and 314 and bounded by the perimeter seal (not shown). Drive side assembly 312 also has array 368 of actuators on its outward surface, which can, for example, be an array of thin film piezoelectric transducers with appropriate traces for electrical connections.

On top of core structure 360 is fluid distribution structure 370, with metal or ceramic tubes 372 and 374 held in position by cross-braces 376 and 378. As shown, fluid enters tube 372 through connector 380 and is provided from tube 372 to opening 364. Similarly, fluid enters tube 374 through connector 382 and is provided from tube 374 to opening 366.

Electrical structure 390 can be formed on flex material such as polyimide with copper and with flex connectors to external circuitry. Circuitry formed on structure 390 includes connector array 392 on the underside for providing signals to actuator array 368, heater elements 394 for heating fluid in tubes 372 and 374, and drivers 396 for providing signals to actuator array 368 through connector array 392. For example, connector array 392 can include solder bumps or contact springs for making electrical contact. Also, drivers 396 can include a respective driver circuit for each actuator in array 368, and each driver circuit can be an application specific integrated circuit (ASIC).

Structures 360, 370 and 390 can be connected to form printhead 350 using any suitable techniques, including conventional printhead manufacturing techniques.

Printhead 350 exemplifies several advantages that can be obtained with techniques described herein. In contrast to printheads formed entirely from etched plates, printhead 350 can include an unoccluded plenum and a relatively simple flow path from the plenum through the drive side assembly and ducting structure to the drop side assembly. In addition to evenly distributing fluid, the plenum can act as a volumetric compliance to dampen acoustic noise that could otherwise cause crosstalk. Meanwhile, the drop side assembly can have a high density of ejection sites per unit area, and greater detail may be obtained than by etching, making it possible to design a printhead to have improved performance within a given volume constraint. Because the ducting structures are produced photolithographically, they can be uniform in height and other characteristics, and can also be designed so that no web structure is necessary to support them. It may be possible to have less components in a printhead. Furthermore, fluid flow characteristics such as capacitance and inlet resistance can be optimized by design, and acoustic or other driving energy can be constrained to the region of interest.

The fabrication techniques described above can also provide advantages. For example, they can be implemented to produce a structure with complex geometry in just a few steps, saving time and money. They allow versatility in feature design, permitting performance optimization.

FIG. 13 illustrates various other structures that could be produced as described above and that might be useful in various other applications. For illustrative purposes, all the structures are shown together on substrate 400, supported on surface 402. Each structure can, for example, include a photoimageable polymer material such as SU-8.

Structure 410 is a closed wall-like structure that encloses an area of surface 402 that supports the other structures. In printhead or other microfluidic applications as described above, structure 410 could be useful to form a seal, such as a perimeter seal in the implementation of FIG. 12; a top structure could be mounted on structure 410 to enclose a volume that can contain fluid. In other applications, this combination of structures could provide a package surrounding and protecting other structures.

Structures 412 and 414 are also wall-like structures, but are not closed. They could similarly have microfluidic functions or could function as spacers or other mechanical components in packaging. In addition, structures like these could extend between and connect to other structures, providing added mechanical stability or affecting fluid flow.

Structures 420, 422, and 424 illustrate different shapes that could be used. Structure 420 is rectangular, structure 422 is oval, and structure 424 is hexagonal. These structures could act as spacers, and might also have microfluidic functions. A smooth shape, such as that of structure 422, would have different microfluidic properties than shapes like structures 420 and 424.

Structure 430 is also rectangular, but with a rectangular central opening. Structure 432 is oval with an oval central opening. Structure 434 is polygonal, but with a circular central opening, illustrating that the central opening need not have the same shape as the outer surface. In addition to applications described above for the structures 420, 422, and 424, these structures with central openings could function, for example, as nozzles or other ducting structures in microfluidic applications.

In addition to their potential applications in microfluidic, packaging, and other mechanical applications, the structures in FIG. 13 might have useful electrical applications if plated with a conductive material as described in co-pending, co-assigned U.S. patent application Ser. No. 11/014,357, which is incorporated herein by reference in its entirety. For example, such a structure could act as an electrical conductor between other components, such as between components on surface 402 and on a top structure (not shown). Also, an electric field formed by charge on such a structure could affect nearby charged particles in a fluid.

Techniques as described above could be applied in various other applications, some of which are mentioned above.

Some of the above exemplary implementations involve specific materials, such as stainless steel or SU-8, but the invention could be implemented with a wide variety of materials. In particular, other metals and alloys and semiconductor and other non-metal layers, including even polymer material such as SU-8, could be used to form plate-like structures. Similarly, various polymer materials other than SU-8 could be used to produce microstructures and other ducting structures, such as polyimide or various other negative and positive photoimageable materials or materials of other kinds. Furthermore, plating techniques could be performed with various materials, as described in co-pending, co-assigned U.S. patent application Ser. No. 11/014,357, which is incorporated herein by reference in its entirety.

Some of the above exemplary implementations involve arrays of microstructures or ducting structures, but the invention could be implemented with a single microstructure or other ducting structure. Furthermore, the above exemplary implementations generally involve freestanding microstructures or ducting structures, but ducting structures that are supported along their length are also within the scope of the invention except as otherwise specifically noted. Also, it would be within the scope of the invention to have additional plate-like structures or assemblies with additional ducting structures between them; for example, a fluidic structure could include a series of plate-like structures and, between each pair of adjacent plate-like structures, an array of ducting structures.

The above exemplary implementations generally involve production of fluidic structures following particular operations, but different operations could be performed, the order of the operations could be modified, and additional operations could be added within the scope of the invention. For example, as noted above, apertures could be produced in any of several different ways. Also, the operations described above generally use liquid polymer material, such as liquid SU-8, to produce a photoimageable structure, but dry film SU-8 could be used, which might be advantageous for a stacked up process and for thickness control. Similarly, SU-8 could be extruded rather than spun on. For adhesion of SU-8, a layer of molybdenum or titanium or an adhesion promoter over stainless steel may be beneficial. Further process variations might include planarizing holes or other features on a substrate prior to deposition of a photoimageable structure, such as with wax or other filling material; producing a photoimageable structure by depositing a series of layers of SU-8 or other polymer and performing partial cure between layers; producing subsets of microstructures within an array from different photoimageable structures, after each of which a partial cure is performed, which would make it possible to have different types of microstructures or differently colored microstructures in a single array or printhead; employing soldering or welding operations for attachment or other connections, which may be especially suitable for ducting structures that each include a photo-defined polymer component that has been metal plated for strength and durability or for ducting structures that are metal components; and producing a diaphragm by sputtering metal onto the surface of a polymer such as SU-8.

While the invention has been described in conjunction with specific exemplary embodiments, it is evident to those skilled in the art that many other alternatives, modifications, and variations will be apparent in light of the foregoing description. Accordingly, the invention is intended to embrace all other such alternatives, modifications, and variations that fall within the spirit and scope of the appended claims.

What is claimed is:

1. A microfluidic structure comprising:

first and second plate-like structures; and two or more photo-defined ducting structures, each extending between the first and second plate-like structures; each ducting structure having a respective inlet opening through which it receives fluid from or near the first plate-like structure, a respective outlet opening through which it provides fluid to or near the second plate-like structure, and a respective duct in which fluid flows through the ducting structure after being received through its inlet opening and before being provided through its outlet opening;

each ducting structure being a freestanding microstructure.

2. The structure of claim 1 in which each ducting structure includes polymer.

3. The structure of claim 2 in which the polymer is SU-8.

4. The structure of claim 2 in which each ducting structure is covered by material plated over the polymer.

5. The structure of claim 1 in which each ducting structure is tube-shaped.

6. The structure of claim 1 in which each ducting structure is supported between the first and second plate-like structures.

7. The structure of claim 1 in which the first plate-like structure has at least one recess defined therein to allow fluid to flow into each ducting structure's inlet opening.

8. The structure of claim 1 in which each ducting structure's inlet opening is near the first plate-like structure.

9. The structure of claim 1 in which the first plate-like structure has defined therein for each ducting structure:

a respective chamber;

a respective inlet path through which fluid flows into the respective chamber; and a respective outlet path through which fluid flows from the ducting structure's chamber to the ducting structure's inlet opening.

10. A microfluidic structure comprising:

first and second plate-like structures;

a first photo-defined ducting structure extending between the first and second plate-like structures; the first ducting structure having an inlet opening through which it receives fluid from or near the first plate-like structure, an outlet opening through which it provides fluid to or near the second plate-like structure, and a duct in which fluid flows after being received through the inlet opening and before being provided through the outlet opening; and a second photo-defined ducting structure extending between the first and second plate-like structures; the second ducting structure having an inlet opening through which it receives fluid from or near one of the first and second plate-like structures, an outlet opening through which it provides fluid to or near the other of the first and second plate-like structures, and a duct in which fluid flows after being received through the inlet opening and before being provided through the outlet opening; the first and second ducting structures both being photo-defined from the same photoimageable structure.

11. The structure of claim 10 in which the first and second ducting structures are both formed by selectively exposing the photoimageable structure and then removing exposed or unexposed parts of the photoimageable structure.

12. Fluidic apparatus comprising:

first and second plate-like structures; and two or more microstructures each extending a respective length between the first and second plate-like structures; each microstructure having a cavity defined therein that contains fluid during operation, the cavity having a maximum dimension perpendicular to the microstructure's length; the ratio of the microstructure's length to the cavity's maximum dimension being approximately two or more.

13. The apparatus of claim 12 in which all the microstructures are freestanding.

14. The apparatus of claim 12 in which the first and second plate-like structures define between them a plenum that holds fluid during operation; the microstructures being within the plenum; each microstructure's cavity extending between the first and second plate-like structures; each of the microstructures having:

a respective set of one or more inlet openings that allow fluid to flow into the microstructure's cavity; and a respective outlet opening that allows fluid from the microstructure's cavity to flow to the second plate-like structure; for each microstructure, the second plate-like structure including:

a respective aperture defined therein, positioned to receive fluid from the microstructure's cavity through the microstructure's outlet opening;

the first plate-like structure including, for each microstructure, a respective portion that includes:

a respective actuator that, in operation, controllably causes pressure variation at a respective first end of a respective volume of fluid extending through the microstructure's cavity, causing fluid to flow from the plenum into the microstructure's inlet opening and through the microstructure's cavity and outlet opening and to be ejected from the respective aperture;

each microstructure's set of inlet openings including at least one of:

an end opening toward the first plate-like structure; the first plate-like structure having one or more recesses therein that extend between an opening to the plenum and the end opening; the cavity receiving fluid from the plenum through the opening to the plenum, the recesses, and the end opening; and one or more lateral openings through which the cavity receives fluid from the plenum;

each microstructure, the respective aperture, and the respective portion of the first plate-like structure being structured so that fluid flow between the plenum and the respective first end has a respective upstream impedance, fluid flow between the respective first end and the aperture has a respective downstream impedance, and the respective downstream impedance is less than the respective upstream impedance.

15. Fluidic apparatus comprising:

a drop side assembly from which fluid exits the apparatus and a drive side assembly from which fluid is driven toward the drop side assembly; the drop side and drive side assemblies defining between them a plenum that holds fluid during operation; and at least one microstructure within the plenum and extending between the drop side and drive side assemblies; each microstructure having an inlet opening through which it receives fluid out of the plenum from or near the drive side assembly, an outlet opening through which it provides fluid to the drop side assembly, and a duct in which fluid flows after being received through the inlet opening and before being provided through the outlet opening;

the drive side assembly including, for each microstructure, an actuator that controllably causes fluid to be received out of the plenum through the microstructure's inlet opening, to flow through the microstructure's duct, and to be provided through the microstructure's outlet opening to the drop side assembly and ejected therefrom as drops.

16. The apparatus of claim 15 in which, for each microstructure, the drop side assembly has an aperture defined therein through which fluid from the microstructure's outlet opening is ejected; the drive side assembly further including, for each microstructure:

a chamber defined in the drive side assembly; the microstructure's actuator causing pressure variation on fluid in the chamber;

an inlet path defined in the drive side assembly through which fluid flows from the plenum to the chamber; the inlet path having an upstream impedance; and an outlet path segment defined in the drive side assembly through which fluid flows from the chamber to the microstructure's inlet opening; the outlet path segment, the microstructure's duct, and the microstructure's aperture together providing an outlet path through which fluid flows from the chamber out of the apparatus; the outlet path having a downstream impedance less than the upstream impedance.

17. The apparatus of claim 16 in which, for each microstructure, the upstream impedance is at least twice the downstream impedance.

18. The apparatus of claim 16 in which, for each microstructure, the inlet path includes an inlet duct within the drive side assembly; the inlet duct providing most of the upstream impedance.

19. The apparatus of claim 15 in which the drop side assembly and the drive side assembly are plate-like structures.

20. The apparatus of claim 15 in which the apparatus includes two or more of the microstructures within the plenum and all the microstructures are freestanding.

21. A printhead comprising:

a drop side assembly from which drops are ejected from the printhead;

a drive side assembly from which fluid is driven toward the drop side assembly; and an array of two or more freestanding polymer microstructures supported between the drop side and drive side assemblies; each microstructure having an inlet opening through which it receives fluid from or near the drive side assembly, an outlet opening through which it provides fluid to the drop side assembly, and a duct in which fluid flows after being received through the inlet opening and before being provided through the outlet opening;

the drive side assembly including, for each microstructure, an actuator that controllably causes fluid to be received through the microstructure's inlet opening, to flow through the microstructure's duct, and to be provided through the microstructure's outlet opening to the drop side assembly and ejected therefrom as drops.

22. The printhead of claim 21 in which the drop side and drive side assemblies define a plenum between them that holds fluid during operation; the array of microstructures being within the plenum; each microstructure receiving fluid out of the plenum through its inlet opening; the drive side assembly further having defined therein at least one fluid opening through which fluid flows into the plenum; the printhead further comprising:

a distribution structure that provides fluid to each fluid opening in the drive side assembly; and an electrical structure that provides signals to each microstructure's actuator.

23. The printhead of claim 21 in which the drop side and drive side assemblies define between them a plenum that holds fluid during operation, the array of microstructures being within the plenum; each microstructure's duct extending between the drop side and drive side assemblies; the drop side assembly including, for each microstructure:

a respective aperture defined therein, positioned to receive fluid from the microstructure's duct through its outlet opening;

the drive side assembly including, for each microstructure, a respective portion that includes the microstructure's actuator; in operation, each microstructure's actuator controllably causing pressure variation at a respective drive-side end of a respective volume of fluid extending through the microstructure's duct;

each microstructure's inlet opening being one of:

an end opening toward the respective portion of the drive side assembly; the respective portion having one or more recesses therein that extend between an opening to the plenum and the end opening; the microstructure's duct receiving fluid from the plenum through the opening to the plenum, the recesses, and the end opening; and a lateral opening through which the microstructure's duct receives fluid from the plenum;

each microstructure, the respective aperture, and the respective portion of the drive side assembly being structured so that fluid flow between the plenum and the respective drive-side end has a respective upstream impedance, fluid flow between the respective drive-side end and the respective aperture has a respective downstream impedance, and the respective downstream impedance is less than the respective upstream impedance.

24. Fluidic apparatus comprising:

first and second plate-like structures that bound a space between them;

in the space and supported between the first and second plate-like structures, two or more freestanding ducting microstructures, each extending a respective length between the first and second plate-like structures; each ducting microstructure having a maximum dimension perpendicular to its length, the maximum dimension being less than 1.0 mm; each ducting microstructure having defined therein:

a respective first opening at or near the first plate-like structure;

a respective second opening at or near the second plate-like structure; and a respective cavity that contains fluid during operation, each microstructure's cavity extending along its length between its first and second openings so that fluid received through one of its first and second openings can flow through its cavity and then be provided through the other of its first and second openings;

each ducting microstructure's cavity having a maximum dimension perpendicular to its length, the ratio of the microstructure's length to its cavity's maximum dimension being approximately two or more;

each ducting microstructure including, around its cavity, at least one of:

patterned polymer photoresist material; and plated material.

25. The apparatus of claim 24 in which each microstructure is tube-shaped, the maximum dimension of each microstructure's cavity being an inside diameter of the microstructure.

26. The apparatus of claim 24 in which the lengths of all the microstructures are approximately equal.

27. Fluidic apparatus comprising:

a drop side assembly from which fluid exits the apparatus and a drive side assembly from which fluid is driven toward the drop side assembly; the drop side and drive side assemblies defining between them a plenum that holds fluid during operation; and an array of microstructures within the plenum, each microstructure in the array having an inner duct defined therein that extends between the drop side and drive side assemblies; each microstructure further having a respective set of one or more inlet openings that allow fluid to flow into the inner duct and a respective drop-side opening that allows fluid from the inner duct to flow to the drop side assembly;

the drop side assembly including, for each microstructure, a respective aperture defined therein, positioned to receive fluid from the microstructure's inner duct through its drop-side opening;

the drive side assembly including, for each microstructure, a respective portion that includes:

a respective actuator that, in operation, controllably causes pressure pulses at a respective drive-side end of a respective volume of fluid extending through the microstructure's inner duct;

each microstructure's set of inlet openings including at least one of:

an end opening toward the respective portion of the drive side assembly; the respective portion having one or more recesses therein that extend between an opening to the plenum and the end opening; the inner duct receiving fluid from the plenum through the opening to the plenum, the recesses, and the end opening; and one or more lateral openings through which the inner duct receives fluid from the plenum;

each microstructure's inner duct, set of inlet openings, drop-side opening, aperture, and portion of the drive side assembly being structured so that fluid flow between the plenum and the respective drive-side end has a respective upstream impedance, fluid flow between the respective drive-side end and the respective aperture has a respective downstream impedance, the respective downstream impedance is less than the respective upstream impedance, and the respective actuator is capable of causing pressure pulses that eject drops of fluid from the microstructure's inner duct through its drop-side opening and aperture.

28. The apparatus of claim 27 in which, for each microstructure, the upstream impedance is at least twice the downstream impedance.

29. A microfluidic structure comprising:

first and second plate-like structures; and a first photo-defined ducting structure extending between the first and second plate-like structures; the first ducting structure having an inlet opening through which it receives fluid from or near the first plate-like structure an outlet opening through which it provides fluid to or near the second plate-like structure, and a duct in which fluid flows after being received through the inlet opening and before being provided through the outlet opening;

the first and second plate-like structures defining between them a plenum that holds fluid during operation; the first ducting structure being within the plenum;

the second plate-like structure including:

an aperture defined therein, positioned to receive fluid from the duct through the outlet opening;

the first plate-like structure including:

an actuator that, in operation, controllably causes pressure variation at a first end of a volume of fluid extending through the duct, causing fluid to flow from the plenum into the first ducting structure's inlet opening and through the duct and the outlet opening and to be ejected from the aperture;

the inlet opening being one of:

an end opening toward the first plate-like structure; the first plate-like structure having one or more recesses therein that extend between an opening to the plenum and the end opening; the duct receiving fluid from the plenum through the opening to the plenum, the recesses, and the end opening; and a lateral opening through which the duct receives fluid from the plenum;

the first ducting structure, first plate-like structure, and second plate-like structure being structured so that fluid flow between the plenum and the first end has an upstream impedance, fluid flow between the first end and the aperture has a downstream impedance, and the downstream impedance is less than the upstream impedance.

* * * * *